US006298636B1

(12) United States Patent
Lachenmeier et al.

(10) Patent No.: US 6,298,636 B1
(45) Date of Patent: Oct. 9, 2001

(54) METHOD AND APPARATUS FOR PACKAGING AN OBJECT

(75) Inventors: Kurt Lachenmeier, Sonderborg; Flemming Thomsen, Garsten, both of (DK)

(73) Assignee: KL-Lachenmeier A/S, Sonderborg (DK)

( * ) Notice: Subject to any disclaimer, the term of this patent is extended or adjusted under 35 U.S.C. 154(b) by 0 days.

(21) Appl. No.: 09/432,527

(22) Filed: Nov. 3, 1999

(30) Foreign Application Priority Data

Nov. 5, 1998 (EP) ..... 98121032

(51) Int. Cl.[7] ..... B65B 9/14; B65B 53/06

(52) U.S. Cl. ..... 53/442; 53/459; 53/557; 53/567

(58) Field of Search ..... 53/442, 557, 459, 53/567, 585

(56) References Cited

U.S. PATENT DOCUMENTS 4,473,990 * 10/1984 Thimon ..... 53/567
4,563,689 * 1/1986 Hannen ..... 53/442
4,651,508 * 3/1987 Hannen ..... 53/557
4,724,658 * 2/1988 Birkenfeld et al. ..... 53/557
5,596,866 * 1/1997 Martin-Cocher et al. ..... 53/442

FOREIGN PATENT DOCUMENTS 0 088 424 3/1983 (EP) .
0 378 730 7/1990 (EP) .
0 283 541 9/1998 (EP) .

* cited by examiner

*Primary Examiner*—John Sipos
(74) *Attorney, Agent, or Firm*—Pearne & Gordon LLP

(57) ABSTRACT

In a method and an apparatus for packaging an object, like a stack of goods (1) disposed on a pallet (2), with a shrinkable foil (8, 20) a foil hood (20) is formed out of a foil hose (8). Said foil hood (20) subsequently is opened by a first gripper means (10, 11), is gripped and is moved to the object. Subsequently, said foil hood (20) is pulled over said object to be packaged and simultaneously shrunk onto said object. Therein, the heating means (17) during pulling over of said foil hood (20) is disposed with a fixed distance above a gripper means (16) for pulling over said foil hood (20) over said object. By the method in accordance with the present invention and by the corresponding apparatus, the output of the plant can be increased, wherein said foil hood (20) is shrunk onto said object essentially without creating folds, without the foils of the good itself or the hood pasting together.

22 Claims, 4 Drawing Sheets

METHOD AND APPARATUS FOR PACKAGING AN OBJECT

BACKGROUND OF THE INVENTION

The invention relates to a method and an apparatus for packaging an object as defined in the preamble of claim 1 or as defined in the preamble of claim 13, Such a method and a corresponding apparatus are in particular used for packaging of stacks of goods which are arranged on a pallet and are to be transferred in any form or other. Due to the foil hood the stack of goods is protected against atmospheric exposure and is given increased stability.

In known methods and apparatuses for packaging objects, in a first treatment step a foil hose in desired length is supplied into a treatment room, is welded into a foil hood and the formed foil hood is cut off. Subsequently, the foil hood is opened and with the aid of grippers of the shrink frame is drawn over the object to be packaged. For shrinking the foil hood onto the object, the shrink frame including a heating means annularly enclosing the object to be packaged, thereafter is moved from the bottom range of the object further again in upward direction. Therein the heating means is switched on so that the foil hood is shrunk onto the object to be packaged under supply of heat.

This method and the corresponding apparatus are quite limited in capacity as the individual method steps are carried out subsequently such that the gripper means at first pulls the foil hood over the object completely before the shrink frame located in the bottom area of the object can start with the shrinking operation. Only after the shrinking operation the packed object is transferred further and the next unpacked object is moved into the apparatus. The cycle time of such a known apparatus, therefore, is comparatively long, this rendering it comparatively expensive in relation to the number of packed objects per unit time.

Furthermore, no particular shrinking quality is achieved. Finally, it is not guaranteed that the foil of already shrunk goods of the objects to be packaged does not glue together with the shrink foil. In order to avoid such pasting together, pressure blowers are proposed which blow up the foil hood in order that the latter does not directly bear on the object. The control of such blowers, however, is very expensive and there exists the danger that the foil hood due to too strong blowing up comes too close to the shrink frame and, therefore, due to too strong heating of the foil hood holes are burnt into the foil hood.

SUMMARY OF THE INVENTION

It is, therefore, the object of the present invention to create a method and an apparatus for packaging an object, in which the output is increased with simultaneously avoiding a pasting together of the foil hood and undesired creation of holes in the foil hood and/or an undesired creation of folds in the foil hood.

This object is solved with a method in accordance with the features of claim 1 and with an apparatus in accordance with the features of claim 13. Preferred embodiments of the invention are disclosed in the depending claims.

In accordance with the method according to the present invention, the foil hood is shrunk when being pulled over the object to be packed. Thereby, the two method steps of pulling over and shrinking are combined chronologically such that the cycle times of the method are shortened and the capacity is increased. Furthermore, the removal by suction of the air or the blowing up of the foil hood can be done without during shrinking since shrinking takes place while the foil hood is pulled over the object. This also permits a particularly uniform and reliable shrinking of the foil material, wherein creation of folds is avoided.

In a preferred embodiment of the present invention, the toil hood is shrunk onto the object by means of a heating means by supply of heat above a gripper means. This permits an efficient and continuous shrinking operation, as during shrinking the heating means can be positioned with a fixed distance to the gripper means and the foil wall.

Preferably, the foil hood is charged with heat, before it comes into contact with the object such that the pulling-over operation of the foil hood over the object essentially occurs without contacting. This avoids possible damages, like fissures or the like, during pulling-over of the foil hood. Furthermore, the foil hood can be shrunk onto the object without creation of folds, this improving its mechanical properties, the resistance to tearing in particular.

In a preferred embodiment of the present invention, heat supply during shrinking of the foil hood is controllable such that objects with irregular surfaces can be shrunk better. In case of irregular surfaces the distance of the foil hood to the heating means varies such that an individual adaptation of heat supply is required for certain areas.

In accordance with a particularly efficient method, at first the foil hood is shrunk onto the object on its upper side and subsequently the heating means is moved in downward direction together with a gripper means maintaining the foil hood in reefed condition. This results in a particularly solid seat of the foil hood on the object.

A further increase in output can be reached when the foil hood is opened by a first gripper means and then is transferred to a second gripper means. Said second gripper means together with the heating means then can initiate the shrinking operation while said first gripper means can take up the subsequent foil hood and bring it into the reefed condition.

In a preferred embodiment, the foil hood is sucked to the inside on the bottom side of the object and at least partly is shrunk onto the bottom side of the object such that the seat of the foil hood becomes particularly solid. For a further increase in stability, the foil hood can be welded together with a bottom foil in its lower region. Thereby, also a sealed packaging of the object can be achieved. In order to make the cycle times as short as possible, the foil hood can be cooled in the heated shrunk area. This permits a particularly high heat supply in short time as the excess heat can be carried off quickly.

In accordance with the apparatus according to the present invention, during pulling-over of the foil hood over an object the heating means is arranged with a fixed distance above a gripper means for pulling over the foil hood. This permits simultaneous pulling-over of the foil hood and shrinking of the latter onto the object. In addition, a reliable and quick shrinking can be carried out as the distance of the foil hood to the heating means is comparatively uniform, in case of objects with irregular surfaces in particular. This permits foodless shrinking and making available of a shrunk foil hood capable of bearing.

In a preferred embodiment of the apparatus according to the present invention, the gripper means for pulling over the foil hood can be coupled to the shrink frame or is connected thereto. In both cases, the distance of the gripper means to the heating means on the shrink frame can be fixed quickly and in simple manner.

Preferably, the apparatus comprises a first movable gripper means for opening the foil hood and a second movable gripper means for pulling over the foil hood such that the gripper means can work in parallel and are adapted to their respective tasks individually. In particular, the first gripper means can comprise several suction boxes for opening the foil hood, whereas the second gripper means can be connected to the shrink frame.

In accordance with a preferred embodiment of the invention, the shrink frame in addition to the heating means also comprises a cooling means by which rapid cooling down of the foil hood is achieved after shrinking. This permits an intense heat supply and a temporal shortening of the shrinking operation.

Preferably, a heat shielding is provided for between said first gripper means and said second gripper means such that the opening of the foil hood can take place in a comparatively protected cooler room and pasting of the subsequent foil can be avoided.

BRIEF DESCRIPTION OF DRAWINGS

In the following the invention is described with reference to an embodiment with reference to the attached drawing. In the drawing

DETAILED DESCRIPTION OF PREFERRED EMBODIMENT

Figure 1:
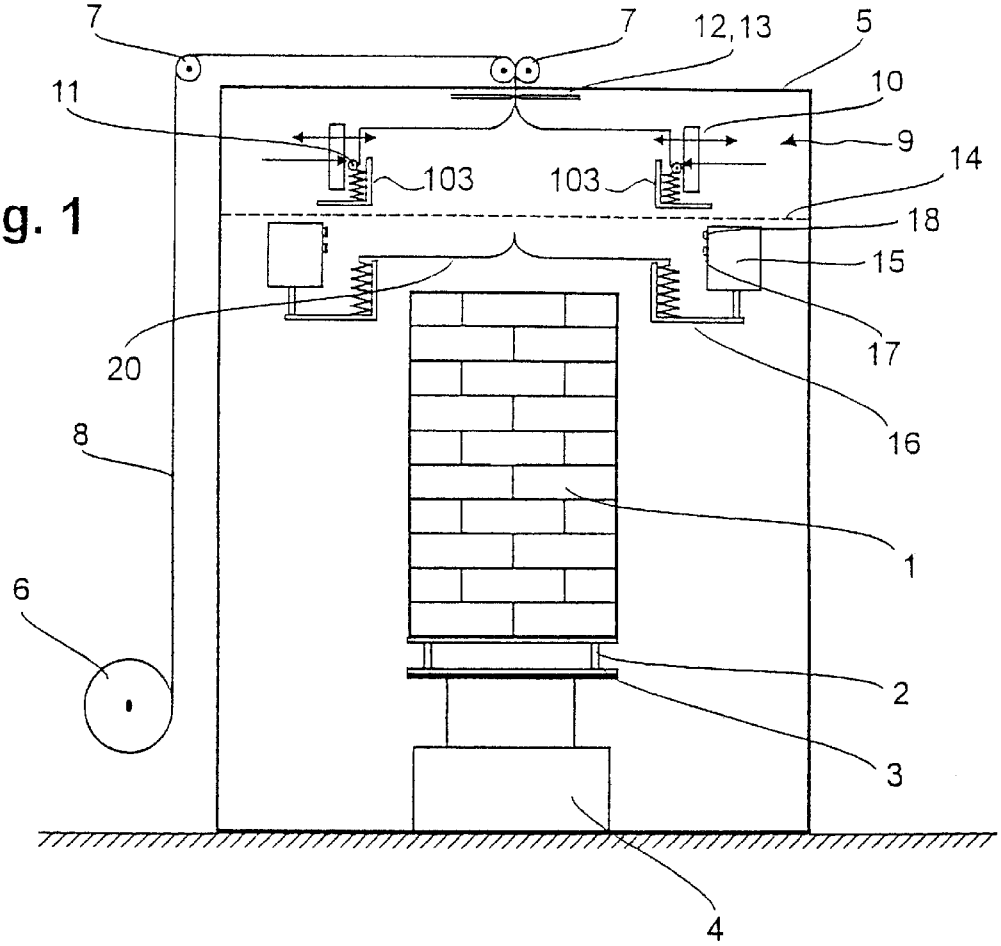
FIG. 1 shows a schematic view of an apparatus in accordance with the present invention.
Figure 2:
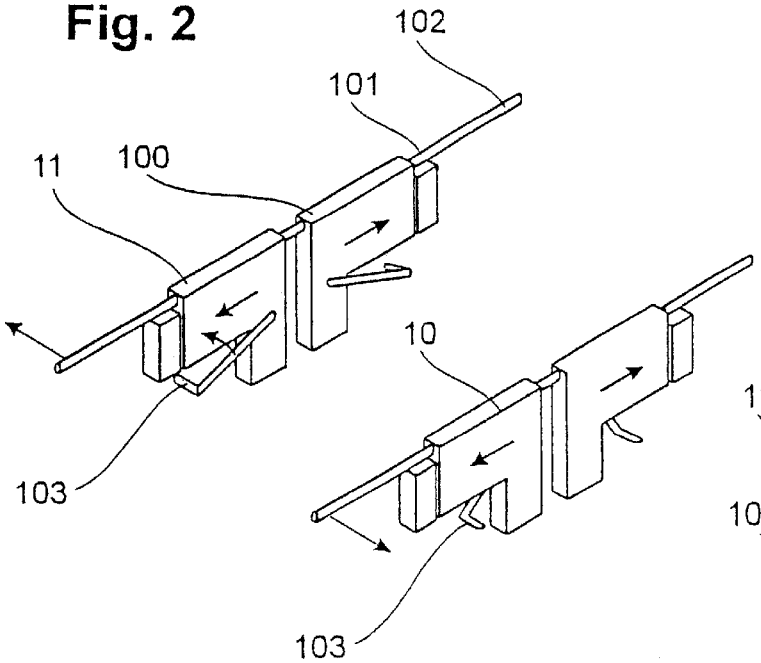
FIG. 2 shows an enlarged view of the gripper means for opening the foil hood.
Figure 3:
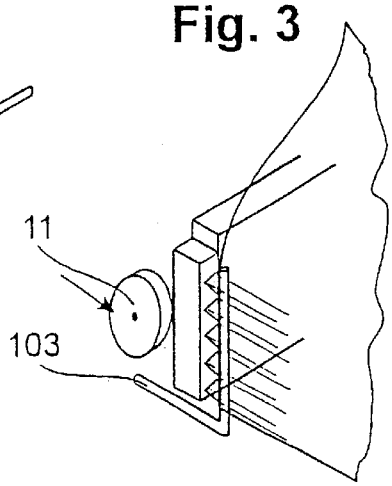
FIG. 3 shows an enlarged view of a section of said first gripper means for opening the foil hood.
Figure 4:
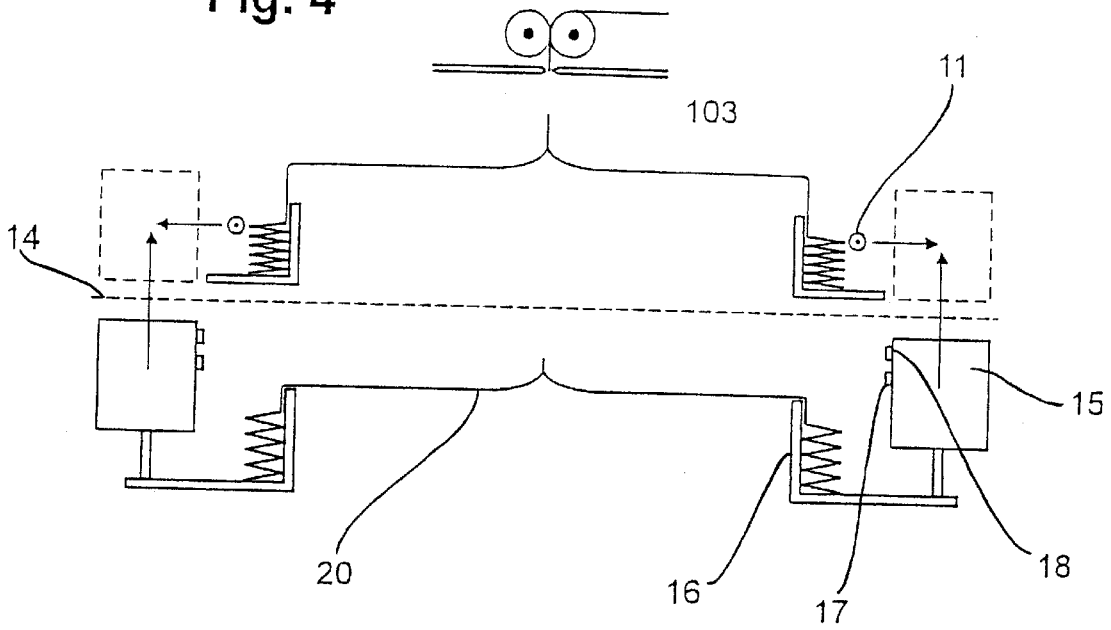
FIG. 4 shows a view of the apparatus in accordance with the present invention, in which the toil hood is shown in various method states.
Figure 5:
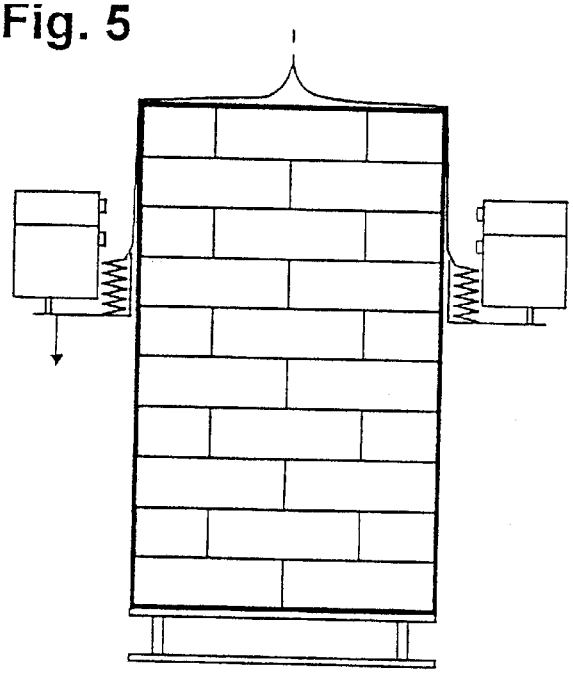
FIG. 5 is a schematic view of the shrinking operation.

In the apparatus in accordance with the present invention, a stack of goods 1 is arranged on a pallet 2 such that pallet 2 and stack of goods 1 form the object to be packaged. Said pallet 2 is arranged on a vertically movable lifting table 3 which is component of a belt conveyor system e.g. and which is supported on a basic part 4.

The object to be packaged in arranged within a stand 5 on which the individual components of the apparatus at least partly are suspended. The foil to be supplied is wound from a foil winding 6 and in form of a foil hose 8 s guided to the upper area of the packaging apparatus through supply rollers 7. Said upper area of the apparatus forms a treatment station 9 in which said foil hose 8 is formed into a foil hood 20 of the desired length.

For this purpose, the subsequent foil hose 8 is opened by means of a first gripper means and is gripped. Therein, gripping fingers 103 are brought into said foil hose. By reef rollers 11 arranged on said gripping fingers 103 said foil hose 8 is conveyed onto said gripping fingers 103, When said foil hose 8 has reached the desired length, it is cut off by a cutting means 12 and is welded together by a welding means arranged therebelow such that a foil hood 20 is formed.

Said first gripper means consists of four suction boxes 100 acting on the respective corners of said foil hose for opening it. On one edge of the suction box a gripper means 101 is provided for by means of which the corresponding foil hose edge can be clamped. Subsequently, the four suction boxes 100 respectively are moved on two parallel axes 102 such that the opened foil hose essentially has the contour of the object to be packaged. A detailed description of the opening system can be found in the DE 43 26 827. Said first gripper means preferably is formed in correspondence with the suction/gripper means disclosed there. However, it also is possible to use other mechanical opening systems.

When the foil hood 20 formed thus, essentially has taken the contour of the object to be packaged, it is transferred to a second gripper means. Said second gripper means comprises four grippers 16 arranged on a shrink frame 15. Between said first gripper means and said second gripper means a heat shielding 14 is provided for which separates the treatment station 9 from the shrink frame in order to not paste together the following foil hood by raising heat. Said heat shielding 14 can e.g. be formed by horizontally movable metal plates. Alternatively or additionally a blower for forming an air curtain can be used.

For transferring the foil hood 20, said second gripper means is moved upwardly to said first gripper means or said first gripper means in moved in downward direction to said second gripper means, the four grippers 16 being moved into the foil hood 20 being in reefed condition, Said first gripper means then moves in inside and downward direction or tilts the gripper arms inwardly and downwardly for handing over said foil hood 20.

As soon as said grippers 16 have taken over said foil hood 20, said first gripper means again moves to the subsequent hose 8 for forming the next foil hood for the next packaging operation.

Said foil hood 20 on said grippers 16 now moves in downward direction until the upper side of said foil hood 20 is located somewhat above the stack of goods. Subsequently, a heating means 17 in form of several annularly arranged gas burners 17 or other suitable heating means, like electroheaters, infra-red radiators and/or the like, is ignited or switched an and a cooling means 18 arranged above said gas burners 17 or said heating means, in form of a cooling air blower is switched on. Simultaneously, said foil hood 20 together with said grippers 16, said shrink frame 15, said heating means 17 and said cooling means 18 is moved in downward direction. During the movement the foil hood is shrunk onto the stack of goods 1, the creation of folds being avoided by the uniform shrinking of the foil hood. Said toil hood 20 in practice is pulled over the stack of goods 1 without touching it and simultaneously is shrunk onto said stack of goods 1 prior to bearing on said stack of goods 1.

In the lower area of said stack of goods, said foil hood 20 is bent and is shrunk under the lower edge of the stack of goods or the pallet such that said foil hood 20 has a solid seat around the stack of goods 1 and said pallet 2.

Figure 6:
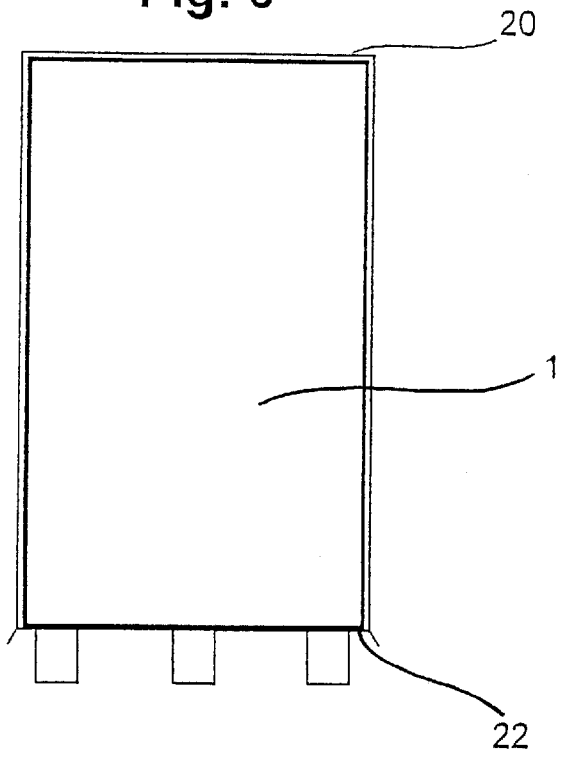
FIG. 6 is a view of the readily packed object.

As is shown in FIG. 6, a bottom foil 22 can be provided for between said pallet 2 and said stack of goods 1 such that said foil hood 20 is welded together with said bottom toil 22. This permits a particularly sealed packaging of said stack of goods 1.

In the following, the packaging process is explained with reference to FIGS. 7 and 8. A stack of goods 1 still to be packaged, on a pallet is transferred to the apparatus in accordance with the present invention.

The shrink frame 15 still Is in the lower area of the stack of goods 1 just packaged. In the closed condition said shrink frame 15 prevents that the object 1' still to be packaged can be transferred into the area of the stand 5 and that the packaged object 1 can be transferred outside of the area of stand 5. Therefore, areas of said shrink frame 15 arranged in supply direction of a conveyor belt 26 are formed by movable sections 26 which can be moved out of the way of the transfer path of said stack of goods 1 and 1'.

Figure 7:
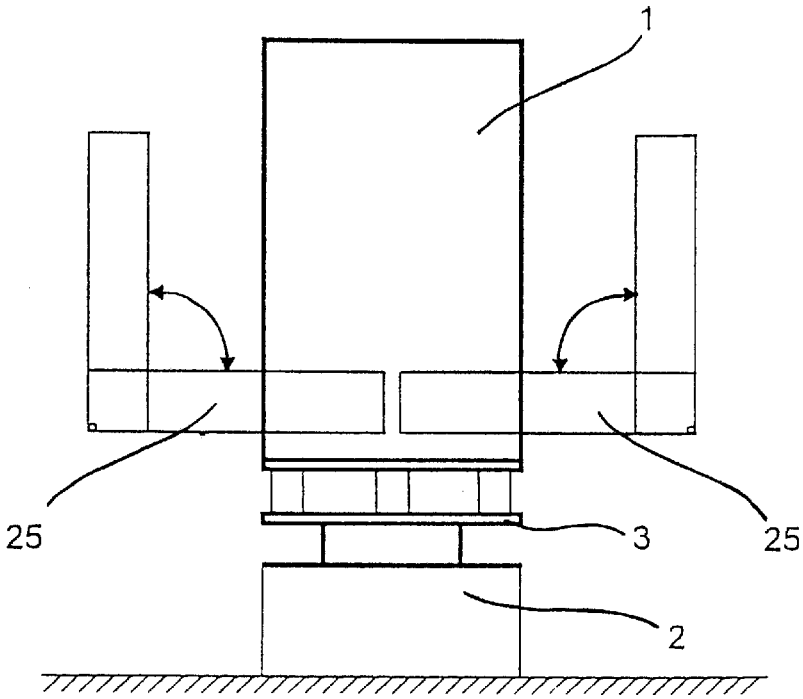
FIG. 7 shows a sectional view of the object to be packaged, on a lifting table.
Figure 8:
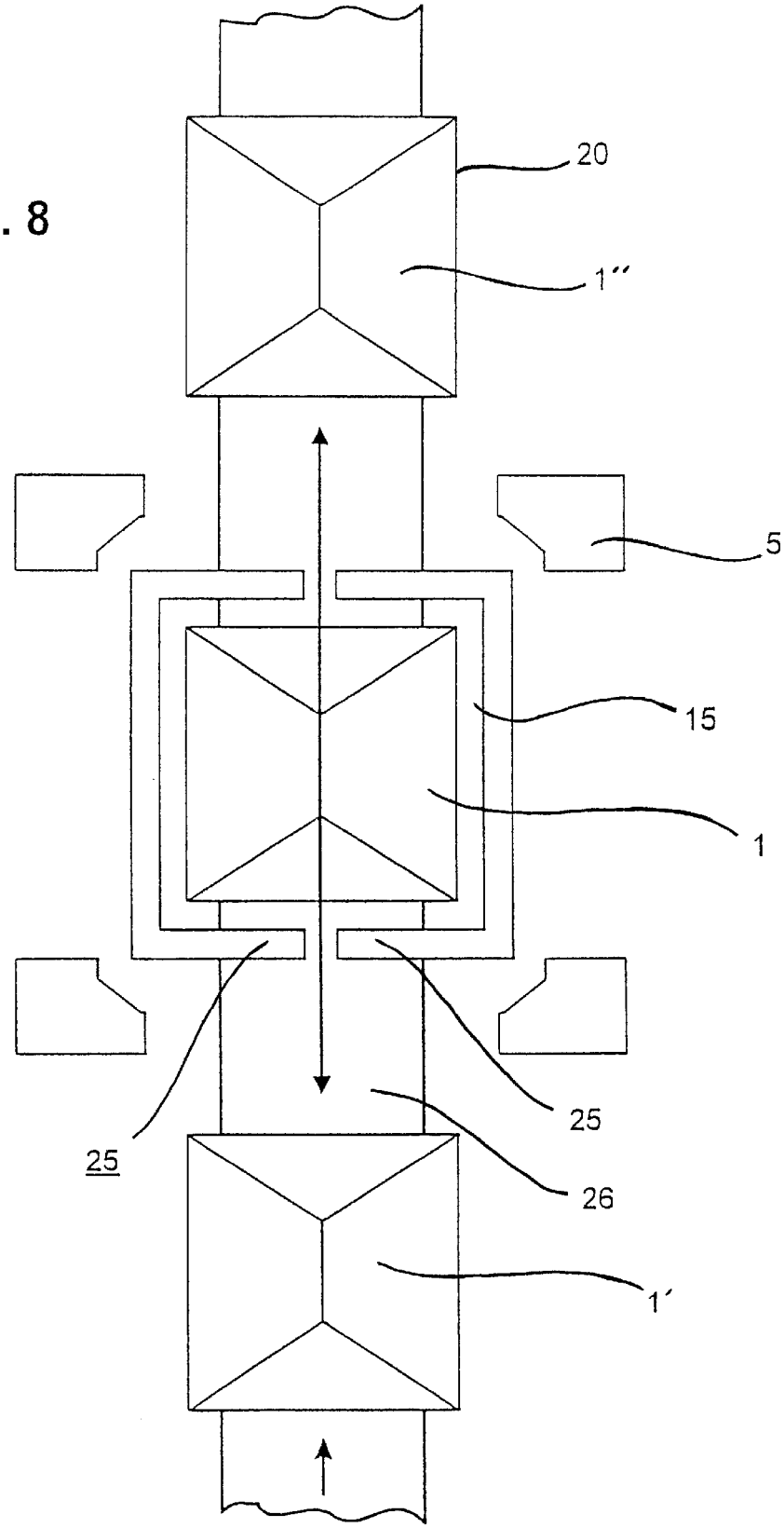
FIG. 8 is a schematic view of the transfer operation through the apparatus in accordance with the present invention.

As can be seen from FIG. 7, said sections 25 of said shrink frame 15 are formed pivotally by suitable means for releasing the stand 5 in direction of said conveyor belt 26. When said sections 25 are pivoted upwardly, the object 1' still to be packaged can be moved into the area of stand 5 of the apparatus to the next foil hood during the upward movement of said shrink frame 15 and can be put onto said lift table 3. Thereupon, the above-described method in accordance with the present invention is carried out and the subsequent foil hood 20 is shrunk onto said stack of goods 1'. As soon as said shrinking operation is finished, said packaged stack of goods 1' is moved out of the area of said stand 5 to position 1' such that again the subsequent stack of goods can be packaged. This method substantially reduces the cycle times and thus contributes to increase of output of the plant.

What is claimed is:

1. Method for packaging an object with a shrinkable foil, said object comprising a paletted stack of goods (1), said method comprising steps of:

forming a foil hood (20) out of a foil hose;

gripping, opening and reefing said foil hood (20) by a gripper means;

pulling said foil hood (20) over the object to be packaged; and simultaneous to said step of pulling, shrinking said foil hood (20) onto said object.

2. Method for packaging an object as defined in claim 1, wherein said step of shrinking is performed by a heating means (17) having a heat supply located above the gripper means (16).

3. Method for packaging an object as defined in claim 1 or 2, wherein said foil hood (20) is charged with heat before said foil hood comes into contact with the object.

4. Method for packaging an object as defined in claim 1 or 2, wherein the heat supply during shrinking of said foil hood (20) is controllable.

5. Method for packaging an object as defined in claim 1 or 2, wherein said foil hood (20) is opened by a first gripper means (10, 11) and then is transferred to a second gripper means (16).

6. Method for packaging an object as defined in claim 5, wherein by the heating means (17) at first the upper side of said foil hood (20) is shrunk onto said object and thereafter both said heating means (17) and said second gripper means (16) holding said foil hood (20) in reefed condition, are moved in downward direction together.

7. Method for packaging on object as defined in claim 1 or 2, wherein said foil hood (20) is sucked to the inside at the bottom side of the object and at least partly is shrunk onto the bottom side of the object.

8. Method for packaging an object as defined in claim 1 or 2, wherein a lower area of said foil hood (20) is welded to a bottom foil (22).

9. Method for packaging an object as defined in claim 1 or 2, wherein said foil hood (20) is cooled in the heated shrunk area.

10. Method for packaging an object as defined in claim 5, wherein during pulling-over of said foil hood (20) said second gripper means (16) and said heating means (17) are moved together.

11. Method for packaging an object as defined in claim 1 or 2, wherein for pulling-over of said foil hood (20) said object is moved into said foil hood.

12. Method for packaging an object as defined in claim 1 or 2, wherein said shrink frame (15) comprises moveable sections (25) which are moved out of a transfer path of the packaged stack of goods (1) and of a subsequent stack of goods (1') after said shrinking operation and that said stacks of goods (1, 1') are moved further in upward direction during the movement of the shrink frame (15).

13. Apparatus for packaging an object with shrinkable foil, said object comprising a stack of goods (1) arranged on a pallet (2), said apparatus comprising:

a supply means (6, 7) for supplying a foil hose (8) to a treatment station (10, 11, 12, 13);

a treatment station (10, 11, 12, 13) for forming a foil hood (20);

a gripper means (10, 11) for opening said foil hood (20) such that the free width of the opened foil hood (20) is at least somewhat larger than the circumference of the object to be packaged; and for pulling said open hood downwardly over said goods, and a shrink frame (15) has been inderted;p and comprising a heating means (17) for shrinking said foil hood (20) onto said object to be packaged, wherein during pulling-over of said foil hood (20) over said object said heating means (17) is arranged with a fixed distance above a gripper means (16) for pulling-over said foil hood (20), and wherein said shrink frame (15) comprises a cooling means (18) for cooling said foil hood (20) above said heating means (17).

14. Apparatus for packaging an object as defined in claim 13, wherein said gripper means (16) for pulling over said foil hood (20) can be coupled to said shrink frame (15).

15. Apparatus for packaging an object as defined in claim 13 or 14, wherein said gripper means (16) for pulling over said foil hood (20) is connected to said shrink frame (15).

16. Apparatus for packaging an object as defined in claim 13 or 14, wherein said a first movable gripper means (10, 11) for opening said foil hood (20) and a second movable gripper means (16) for pulling over said foil hood (20) are provided for.

17. Apparatus for packaging an object as defined in claim 13 or 14, wherein said gripper means (10, 11) for opening said foil hood (20) comprises four gripping arms (103) arranged rectangularly and for suction boxes (100).

18. Apparatus for packaging an object as defined in claim 13 or 14, wherein said gripper means (16) for pulling over said foil hood (20) comprises four gripping fingers (16) arranged rectangularly, which can be moved into said opened foil hood (20) for taking over the reefed foil hood.

19. Apparatus for packaging an object as defined in claim 13 or 14, wherein said object to be packaged is arranged on a lift table (3) in whose area a suction blower is provided for.

20. Apparatus for packaging an object as defined in claims 13 or 14, wherein said gripper means for opening said foil hood (20) simultaneously is the gripper means for pulling over said foil hood (20).

21. Apparatus for packaging an object as defined in claims 13 or 14, wherein said shrink frame (15) comprises at least one movable section arranged in a transfer direction of the stack of goods(1).

22. Apparatus for packaging an object as defined in claim 21, wherein said shrink frame (15) on two opposing sides comprises two movable sections (25) respectively, which can be pivoted out of the path of transfer of the stack of goods (1, 1').

* * * * *

UNITED STATES PATENT AND TRADEMARK OFFICE

CERTIFICATE OF CORRECTION

PATENT NO. : 6,298,636 B1
DATED : October 9, 2001
INVENTOR(S) : Lachenmeier et al.

It is certified that error appears in the above-identified patent and that said Letters Patent is hereby corrected as shown below:

Column 1,
Line 3, please delete "claim 13," and insert -- claim 13. --.

Column 2,
Line 6, please delete "toil" and insert -- foil --.

Column 3,
Line 54, please delete "8 s" and insert -- 8 is --.

Column 4,
Line 26, please delete "in" (first occurrence) and insert -- is --.
Line 28, please delete "condition," and insert -- condition. --.
Line 49, please delete "toil" and insert -- foil --.
Line 66, please delete "Is" and insert -- is --.

Column 5,
Line 52, please delete "on" and insert -- an --.

Column 6,
Line 19, please delete "packaged;" and insert -- packaged, --.
Line 20, please delete "goods," and insert -- goods; --.
Line 21, please delete ""has been inderted;p" and insert -- for downwardly moving over said goods --.
Line 57, please delete "claims" and insert -- claim --.

Signed and Sealed this

Nineteenth Day of March, 2002

*Attest:*

*Attesting Officer*

JAMES E. ROGAN
*Director of the United States Patent and Trademark Office*